US006637050B1

(12) United States Patent
Ball

(10) Patent No.: US 6,637,050 B1
(45) Date of Patent: Oct. 28, 2003

(54) OVERFLOW ASSEMBLY FOR BATHTUBS AND THE LIKE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/222,062

(22) Filed: Aug. 16, 2002

(51) Int. Cl.[7] ..... E03C 1/24

(52) U.S. Cl. ..... 4/680; 4/679; 138/89; 285/3

(58) Field of Search ..... 138/89, 90; 4/651, 4/679, 680, 683, 684, 685, 694; 285/3; 73/49.1

(56) References Cited

U.S. PATENT DOCUMENTS 427,478 A * 5/1890 McEvoy ..... 138/89 X
1,213,466 A * 1/1917 Delanoy et al. ..... 285/3
5,890,241 A 4/1999 Ball ..... 4/679 X
6,192,531 B1 * 2/2001 Fritz et al. ..... 4/679

FOREIGN PATENT DOCUMENTS

CH 346187 * 6/1960 ..... 4/679

* cited by examiner

*Primary Examiner*—Robert M. Fetsuga

(57) ABSTRACT

A one-piece overflow fitting is provided for a bathtub having a one piece overflow pipe. The one piece overflow pipe has an inverted L-shape having an elbow portion defining an upper end portion and a lower end portion. The upper end portion has an outer end defining an inlet adapted to fit through a bathtub overflow port. Threads are located on an outer surface of the upper end portion and surround the inlet. A lip extends radially outwardly from an outer surface of the overflow pipe between the elbow portion and the upper end portion to engage an outer surface of the bathtub end wall around the bathtub overflow port. A thin diaphragm is sealed to the outer end of the upper end portion to close the inlet to fluid flow.

7 Claims, 4 Drawing Sheets

OVERFLOW ASSEMBLY FOR BATHTUBS AND THE LIKE

BACKGROUND OF THE INVENTION

In new building construction, the plumbers prefer not to put the finished closure valves in the bottom of tubs, or the finished decorative plate over the overflow outlet at the end of the tub until the project is finished. The plumbers prefer this because these elements will often be damaged as the construction project is brought to a close. Further, the piping for both of the outlets needs to be checked for leaks before the inspection process is completed. This test involves running water down a vent attached to the drain until the water reaches a level above the tub. The tester then determines whether any of the piping leaks. Thus, when the testing operation is to take place, a plug is put in the bottom drain of the tub and some sort of seal plate is placed at the end of the tub on the overflow outlet.

Existing overflow plates have a center opening therein. There are either two or four small screw holes in the plate adjacent to the center opening. These screw holes are used to hold the plate to the plumbing fixture. The testing procedure usually involves stuffing a balloon through the large center opening into the pipe in the wall. The pipe is sealed when the balloon is inflated. Further, existing seal plates normally have to be removed when the decorative plate is put on.

It is therefore an object of this invention to provide an overflow fitting which will safeguard the overflow system during construction.

A further object of the invention is to provide an overflow fitting which will prepare the overflow system for testing.

A still further object of the invention is to provide an overflow fitting which allows a user to install the overflow fitting without using solvent cement.

These and other objects will be apparent to those skilled in the art.

SUMMARY OF THE INVENTION

A one-piece overflow fitting is provided for a bathtub having a one piece overflow pipe. The one piece overflow pipe has an inverted L-shape having an elbow portion defining an upper end portion and a lower end portion. The upper end portion has an outer end defining an inlet adapted to fit through a bathtub overflow port. Threads are located on an outer surface of the upper end portion and surround the inlet. A lip extends radially outwardly from an outer surface of the overflow pipe between the elbow portion and the upper end portion to engage an outer surface of the bathtub end wall around the bathtub overflow port. A thin diaphragm is sealed to the outer end of the upper end portion to close the inlet to fluid flow.

DESCRIPTION OF THE PREFERRED EMBODIMENT

Figure 1:
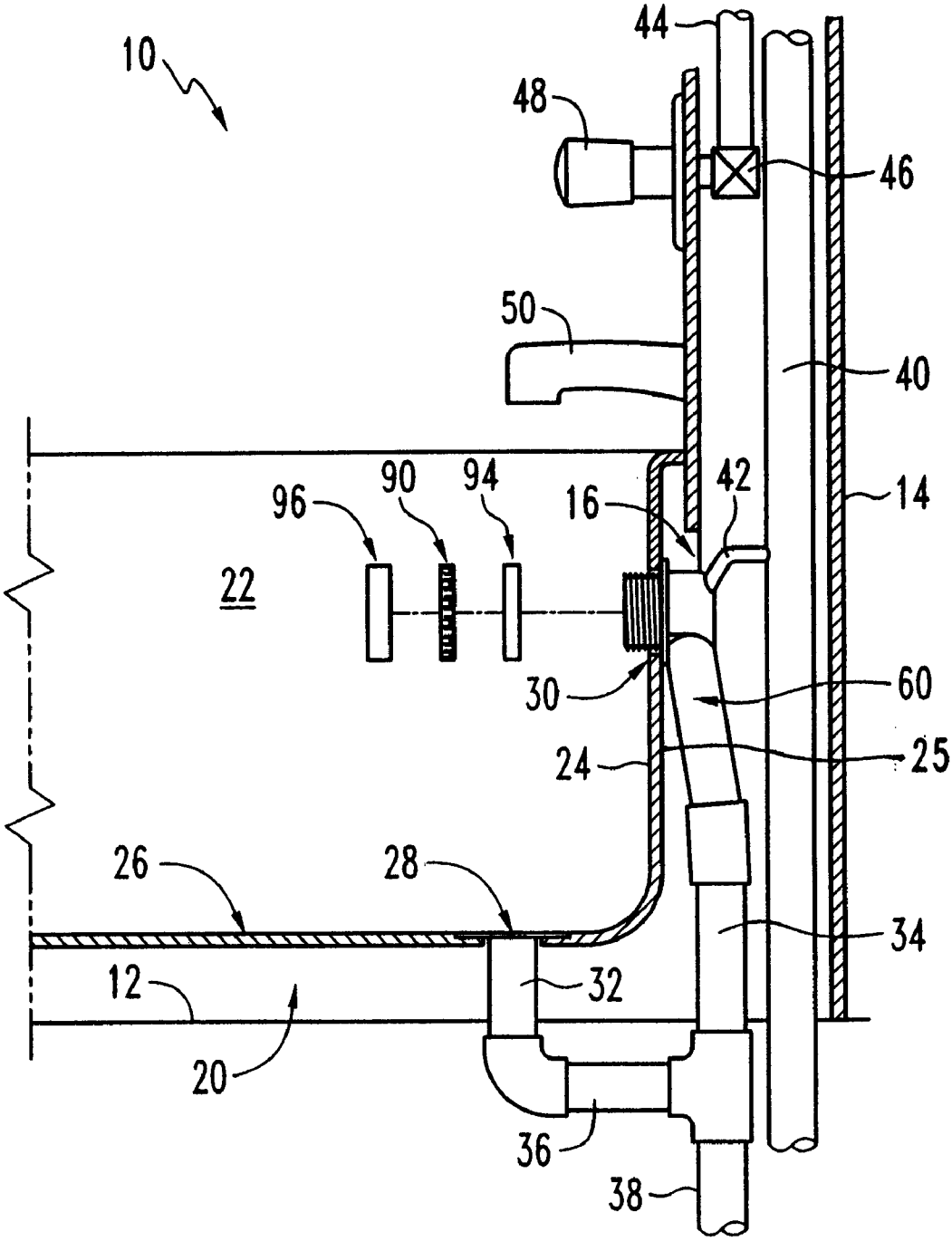
FIG. 1 is a sectional side view of a conventional bathtub environment utilizing the device of this invention.

With reference to FIG. 1, a conventional bathroom structure 10 has a floor 12, and a hollow wall 14 with a wall opening 16 therein. A conventional bathtub (hereinafter "tub") 20 rests upon floor 12.

The tub 20 has side walls 22, end walls 24, and a bottom 26. The side walls 22 extend upwardly from the bottom 26. The end walls 24 extend upwardly from the bottom 26, perpendicular to the side walls 22, and have an outer surface 25.

A drain port 28 is located in the bottom 26. A conventional overflow port 30 is located in the end wall 24. A first vertical drain pipe 32 extends downwardly from drain port 28. A second vertical drain pipe 34 extends downwardly from the overflow port 30. A horizontal pipe 36 connects pipes 32 and 34. A primary drain pipe 38 extends downwardly from the junction of pipes 34 and 36.

A conventional vertical vent pipe 40 is located within the hollow wall 14. A connector vent pipe 42 is in fluid flow communication with the vent pipe 40 and the upper end of the second vertical drain pipe 34.

Conventional water pipes 44 extend through hollow wall 14 and are connected to a valve 46. The valve 46 is interconnected with conventional control members 48 and faucet 50. A one-piece overflow fitting 60 is attached to the second vertical drain pipe 34, and a portion of the overflow fitting 60 passes through overflow port 30.

Figure 2:
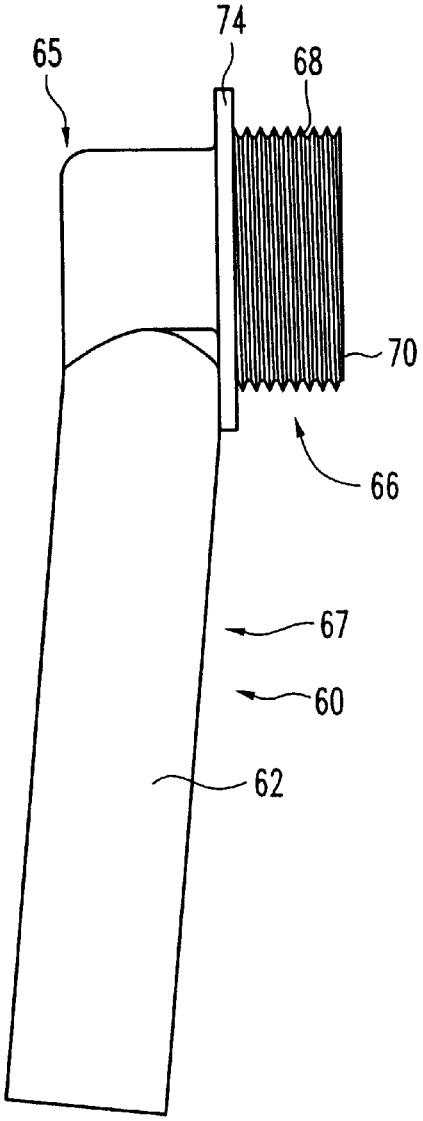
FIG. 2 is a side view of the device of this invention.
Figure 3:
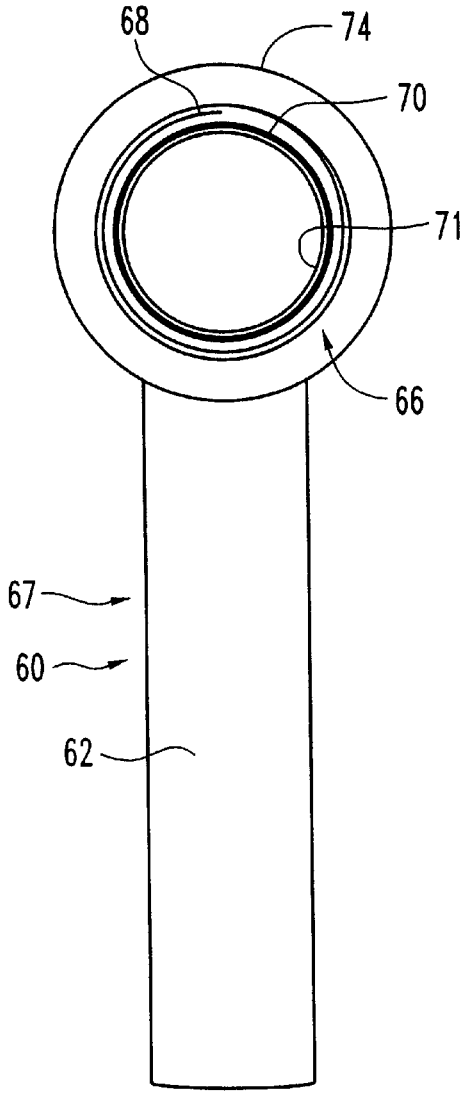
FIG. 3 is a front view of the device of this invention.
Figure 4:
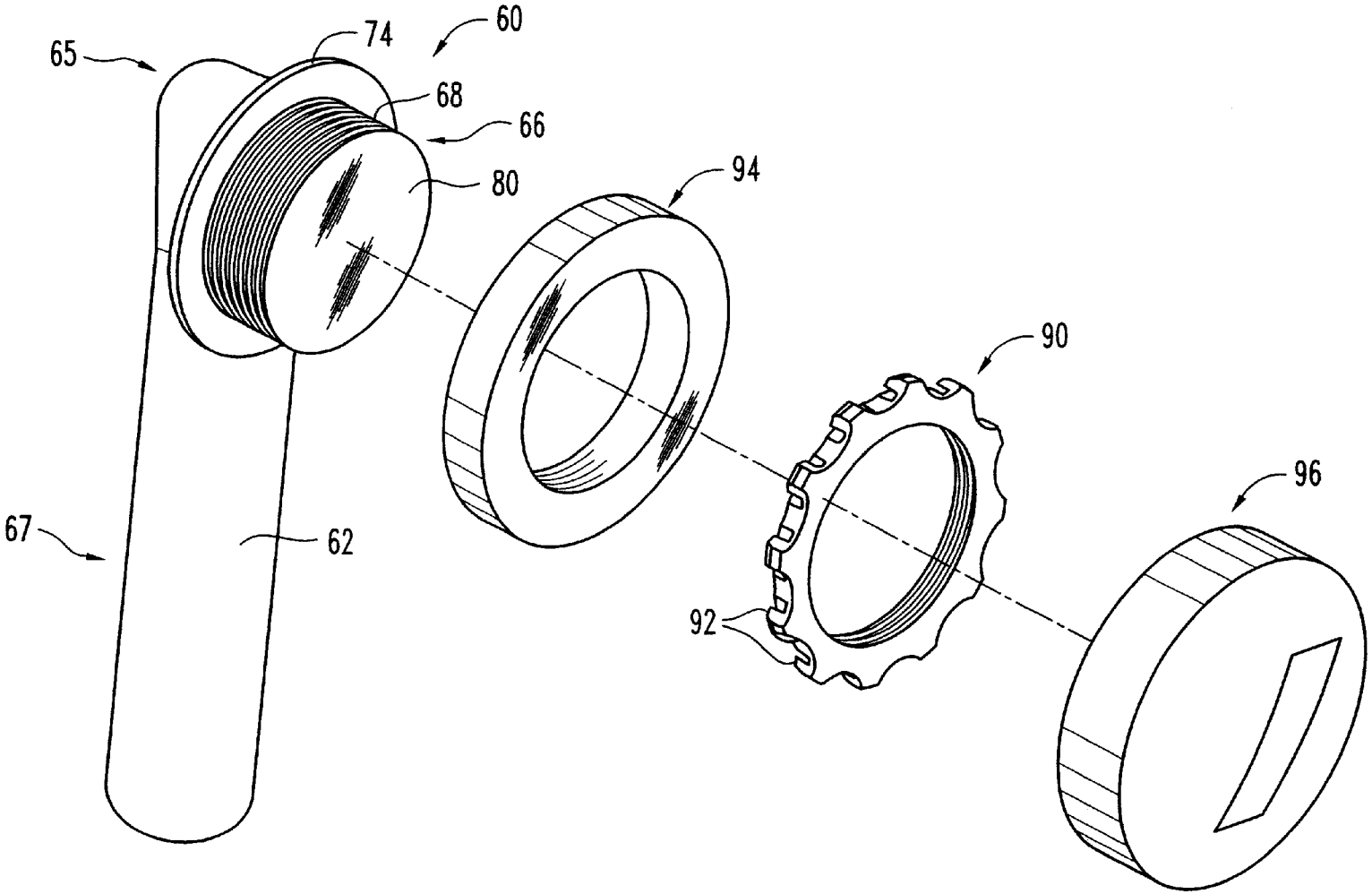
FIG. 4 is an exploded perspective view of the device of this invention.

With reference to FIGS. 2–4, the overflow fitting 60 has an overflow pipe 62 with an inverted L-shape. The overflow pipe 62 has an elbow portion 65 which defines an upper end portion 66 and a lower end portion 67. It will be understood that the overflow pipe 62 may be made of copper, plastic, or any other suitable material.

The upper end portion 66 has threads 68 on its outer surface and also has an outer end 70. The outer end 70 defines an inlet 71 to the upper end portion 66 of the overflow pipe 62. The inlet 71 is adapted to fit through the bathtub overflow port 30.

The overflow fitting 60 also has a lip 74 extending radially outwardly from an outer surface of the overflow pipe 62 between the elbow portion 65 and the upper end portion 66. The lip 74 is spaced from the inlet 71 to engage an outer surface 25 of the bathtub end wall 24 around the bathtub overflow port 30, thereby allowing only the upper end portion 66 to pass through the overflow port 30.

A thin diaphragm 80 is sealed to the outer end 70 of the end portion 66. The diaphragm 80 is a circular membrane and has a diameter that is not less than the diameter of the outer end 70 of the overflow pipe 62. In one embodiment, the diaphragm 80 is integral with the outer end 70 and is held to the outer end 70 only through having been integrally formed therewith. The diaphragm 80 may be hermetically sealed to the outer end 70. The diaphragm 80 may be composed of plastic material, flexible rubber, or the like. The diaphragm 80 is composed of a material that is easily punctured or easily removable.

Referring to FIGS. 1 and 4, the overflow pipe fitting 60 further includes, a nut element 90 having threads compatible with the threads 68 on the upper end portion 66 of the overflow pipe 62. The nut element 90 removably secures the overflow pipe 62 to the bathtub 20 by compressing the end wall 24 between the nut element 90 and the lip 74. The nut element 90 may be a slip nut.

As shown in FIG. 4, the nut element 90 has a series of radially extending lugs 92 along the nut 90 outer periphery. These lugs 92 detachably engage the inner surface of a cap 96. The cap 96 serves to encase the lugs 92 and cover the overflow pipe fitting 60 hardware.

During installation of the overflow pipe fitting 60, a washer 94 may be placed between the upper end portion 66 of the overflow pipe 62 and the nut element 90. The washer 94 seals the overflow pipe fitting 60 to the tub 20.

In operation, the drainage system of the ports 28 and 30; pipes 32, 34, 36, 38; and the overflow pipe fitting 60 are installed as shown in FIG. 1. Vertical vent pipe 40 and connector vent pipe 42 are also installed.

In the testing procedure, the port 28 is plugged in any conventional manner. The overflow pipe fitting 60 is attached to the second vertical drain pipe 34 already plugged by the diaphragm 80 as described above, so there is no fluid access to the upper end of pipe 34 either inwardly or outwardly out of the overflow port 30. The vertical vent pipe 40 is charged with water at some elevation above pipe 42 so that it can be determined if there are any leaks in the system.

Figure 5:
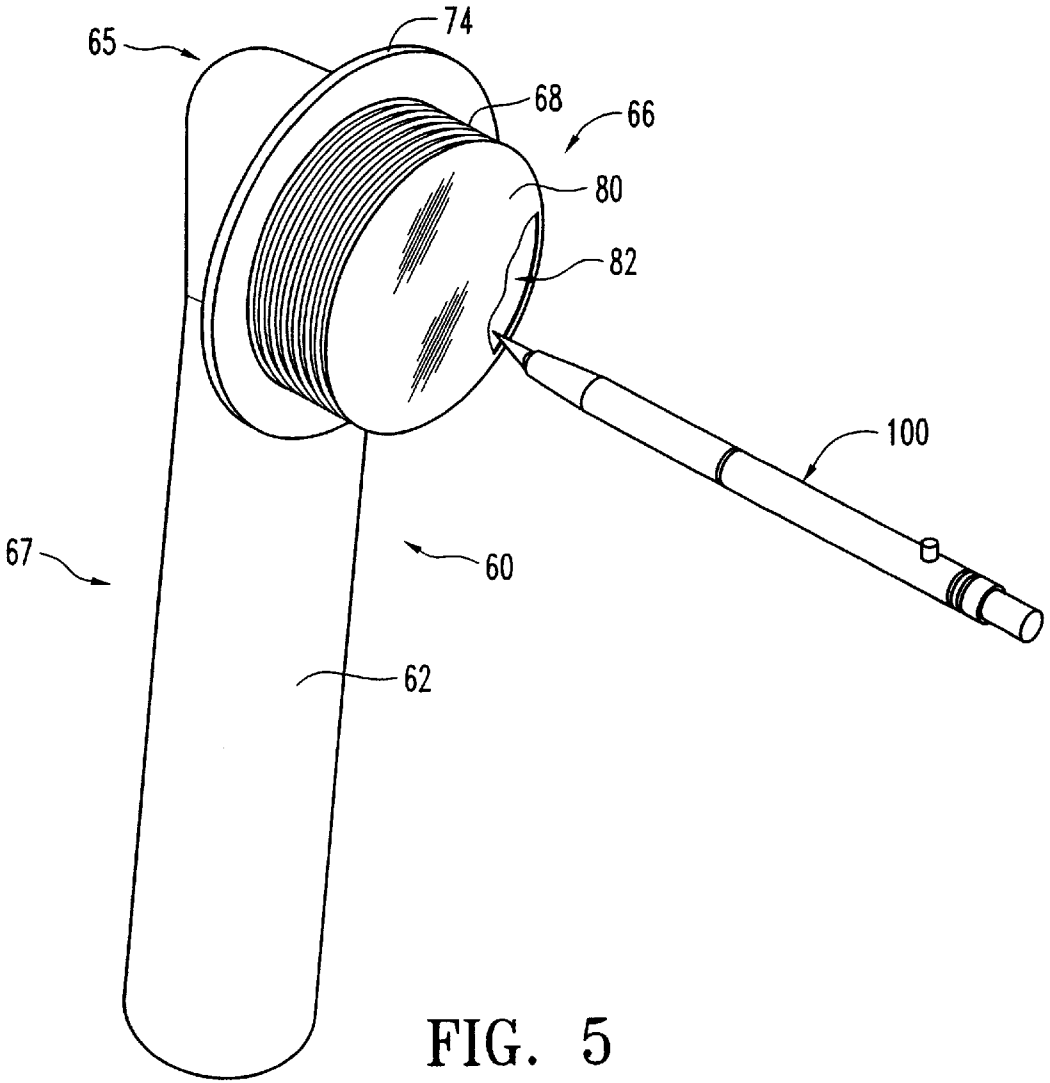
FIG. 5 is a perspective view of the installation of the device of this invention.

With reference to FIG. 5, having determined that there are no leaks, the water is purged from the system. The plumber can then approach overflow port 30, and by using a cutting device 100, such as a knife of any other sharp object, cuts 102 can be made in the diaphragm 80. This can be quickly and easily done without disassembling any of the structure of overflow pipe fitting 60. Any valve linkage elements required may be installed through cuts 102, and any cap or cover for the overflow port 30 may be placed over the overflow pipe 62 end portion 66.

It is therefore seen that this invention eliminates any need to seal shut the overflow pipe 62 after the pipe 62 has been attached to the second vertical drain pipe 34. The invention also eliminates any need to remove sealing components from the overflow port 30 after the testing procedure has taken place. In addition, the invention allows a user to install the overflow fitting 60 without using solvent cement.

It is therefore seen that this invention will accomplish at least all of its stated objectives.

I claim:

1. An assembly for a bathtub which has a bottom and adjacent side and end walls, and an overflow port in an end wall, comprising:

a one-piece overflow fitting comprising:

an overflow pipe with an inverted L-shape having an elbow portion defining an upper end portion and a lower end portion, the upper end portion having an outer end defining an inlet being adapted to fit through the bathtub overflow port;

threads on an outer surface of the upper end portion and surrounding the inlet and normally extending through the bathtub overflow port;

a lip extending radially outwardly from an outer surface of the overflow pipe between the elbow portion and the upper end portion and being spaced from the inlet to engage an outer surface of the bathtub end wall around the bathtub overflow port; and a thin diaphragm sealed to the outer end of the upper end portion to close the inlet to fluid flow;

a nut element compatible with the threads wherein the nut element has a threaded portion for threadibly mounting the nut to the upper end portion to clamp the overflow fitting to the end of the bathtub between the lip and the nut element, and at least one lug extending radially from the nut; and a cap detachably encased to the lug and covering the nut.

2. The one-piece overflow fitting of claim 1, wherein the diaphragm is of plastic material.

3. The one-piece overflow fitting of claim 1, wherein the diaphragm is integral with the outer end and is held to the outer end only through having been integrally formed therewith.

4. The one-piece overflow fitting of claim 1, wherein the diaphragm is hermetically sealed to the outer end.

5. The one-piece overflow fitting of claim 1, wherein the one-piece overflow fitting is adapted to be installed in the end wall of a bathtub without solvent cement.

6. The assembly of claim 1, wherein the nut is a slip nut.

7. A one-piece overflow assembly fitting for a bathtub which has a bottom and adjacent side and end walls, and an overflow port in an end wall, comprising:

an overflow pipe with an inverted L-shape having a lip on an outer surface an elbow portion defining an upper end portion and a lower end portion, the upper end portion having threads on the outer surface and an outer end defining an inlet to the end portion of the overflow pipe being adapted to fit through the bathtub overflow port;

threads on an outer surface of the upper end portion and surrounding the inlet and normally extending through the bathtub overflow port;

a lip extending radially outwardly from an outer surface of the overflow pipe between the elbow portion and the upper end portion and being spaced from the inlet to engage an outer surface of the bathtub end wall around the bathtub overflow port;

a thin diaphragm sealed to the outer end of the upper end portion to close the inlet to fluid flow; and wherein the diaphragm is a circular membrane and has a diameter that is not less than the diameter of the outer end of the overflow pipe.

* * * * *